US007028990B2

(12) United States Patent
Shorey et al.

(10) Patent No.: US 7,028,990 B2
(45) Date of Patent: Apr. 18, 2006

(54) TEMPORARY ROOFTOP AND STAIRWAY SAFETY RAIL SYSTEM

(76) Inventors: Ray Robert Shorey, 902 Transport Way, Petaluma, CA (US) 94954; Jess Dewey Janssen, 4397 Hessel Ct., Sebastopol, CA (US) 95472

( * ) Notice: Subject to any disclaimer, the term of this patent is extended or adjusted under 35 U.S.C. 154(b) by 0 days.

(21) Appl. No.: 10/477,550

(22) PCT Filed: May 11, 2001

(86) PCT No.: PCT/US01/15337

§ 371 (c)(1),
(2), (4) Date: Nov. 12, 2003

(87) PCT Pub. No.: WO02/092946

PCT Pub. Date: Nov. 21, 2002

(65) Prior Publication Data

US 2005/0173689 A1 Aug. 11, 2005

(51) Int. Cl.
*E04G 3/00* (2006.01)

(52) U.S. Cl. ..... 256/1; 256/19; 256/59; 248/135

(58) Field of Classification Search ..... 256/1, 256/19, 59, 65.01, 65.14, DIG. 6; 248/135, 248/237

See application file for complete search history.

(56) References Cited

U.S. PATENT DOCUMENTS 2,329,415 A * 9/1943 Osborne ..... 248/237
3,595,510 A * 7/1971 Hutchinson ..... 248/175
5,570,559 A * 11/1996 Lewis ..... 52/749.12
5,750,559 A * 5/1998 Bianco ..... 514/428

* cited by examiner

*Primary Examiner*—John R. Cottingham
(74) *Attorney, Agent, or Firm*—Johnson & Stainbrook LLP; Craig M. Stainbrook; Larry D. Johnson

(57) ABSTRACT

A temporary rooftop and stairway safety rail system (16*a* & 16*b*) adapted to prevent workers from falling from a work surface at a height. The system includes a plurality of safety rail support assemblies (16) having a vertical support member (52) with members for retaining horizontally disposed safety rail boards (58). The safety rail support assemblies (16) may be mounted on walls (22) and roof rafters (18), and the pitch of the vertical support members is easily adjusted to the slope of the work surface using a system of removable pins (32).

9 Claims, 5 Drawing Sheets

TEMPORARY ROOFTOP AND STAIRWAY SAFETY RAIL SYSTEM

BACKGROUND OF THE INVENTION

1. Technical Field

The present invention relates generally to devices for the protection of construction workers at the work site, and more particularly to a temporary rooftop and stairway safety rail system for installation at the edge of a either a flat or pitched roof or on an unprotected stairway to prevent workers from falls.

2. Background Art

Roofing or other rooftop construction work performed at some height, and work on unprotected stairways, are inherently dangerous undertakings, the obvious danger being the risk of falling. Any job-related injury suffered by a worker results in lost company productivity and profitability, and governmental losses related to paying out for workman's compensation claims. So great is the risk of falling, and so frequent are injuries resulting from rooftop and stairway falls, that the United States Occupational Safety and Hazard Administration (OSHA) now requires a rooftop barrier to be placed at the edge of a roof where work is being performed. OSHA standards require that the barrier be placed approximately 42 inches above the roof edge and be able to withstand a 200 pound static load in multiple directions.

Several solutions to the problem of rooftop safety have been proposed, some comprising elaborate, expensive, and unwieldy ground-based scaffolding systems, other consisting of little more than simple roping systems that involve securing or anchoring workers to the roof with ropes connected to a wearable harness. The latter systems, dubbed "tie-off" systems, have obvious disadvantages, including the difficulty in finding suitable anchors and the awkwardness of working in a harness among a network of ropes. A few relatively recent solutions directed to rooftop safety rail systems include the following:

(1) U.S. Pat. No. 5,515,941 to Palmer et al, which discloses a guard structure for installation at the edge of a building roof eave to assist in shingling. The system employs a plurality of spaced roof cleats nailed to the roof, each having a hinge at its lower end with a hinge axis parallel to the eave. Each hinge connects the cleat to a respective vertical support member at a junction portion immediately adjacent to the eave. The portion of the support member below the eave or roof line engages the building structure, e.g. the rafter tail or fascia board, usually through a pressure plate, and may carry a screw-threaded adjustment member for adjusting the vertical attitude of the support member. The other portion of the support member has a lower outward upward inclined part carrying a toe board retainer member for an inclined toe board, and an upper vertical part carrying at least two vertically spaced back rail support members, as is usually required by safety regulations. The toe board and the back rails form a safety structure for the roofer. Metal safety straps may be provided extending longitudinally beneath the toe boards to prevent catastrophic breakage if they sag excessively. The upper vertical part may also be provided with a retainer for a vertical horizontally extending catch board; when such a catch board is provided it cooperates with the toe board to form a catch space to prevent debris falling from the structure to the ground and also provides an improved safety structure.

While the roof eave mounting guard structures disclosed in Palmer et al provides some measure of protection from falling from a rooftop, in order to be attached to a rooftop it requires that a fascia board be fastened to the outer ends of the roof's rafter frames. Furthermore, it extends outwardly from the end of the roof, thereby having limited structural strength and integrity.

(2) U.S. Pat. No. 5,647,451, to Reichel, teaches a portable roof guard rail support device adapted for fastening directly to a pitched roof. It may be adjusted to the pitch of the roof. The system comprises a roof attachment plate for attaching directly to the roof, a support beam pivotally connected to the roof attachment plate, an angle adjustment brace removably connected to the roof attachment plate and rotatably connected to the support beam for varying the angle at which the support beam is connected to the roof attachment plate, a plurality of cross bar channels through the support beam for attaching removable cross bars, and a channel within the support beam for storing the angle adjustment brace for transportation.

The roof guard rail support device of Reichel attaches directly to the pitched rooftop itself; thus, it is not well suited for work in removing or installing new roofs. Additionally, the Reichel device must be positioned inwardly at least some distance from the edge of the roof as its base plate, which supports the support beam, extends down the slope of the roof from the lower end of the support beam. Accordingly, at least some area of the roof is inaccessible while the roof guard rail support device is installed.

(3) Finally, U.S. Pat. No. 5,711,398 to Bartholomew, discloses a safety rail system for use during construction or maintenance repair of pitched roofs. The system includes multiple, spaced apart rail support assemblies, each of which resides over a respective joist and provides means for receiving and supporting safety planks. Each support assembly is detachably secured in place by a J-hook structure that is inserted into the gap between adjacent courses of roof sheet overlay and lockingly engages the underlying joist.

The patent to Bartholomew teaches another rooftop safety rail system that must be attached directly to the pitched roof. Accordingly, it has the same disadvantages as those in Reichel. Additionally, it does not permit installation on a vertical wall rather than a pitched roof, and this limitation applies to each of the other above-described devices. Thus, it is not suited for installation on an elevated walkway, stairway, or wall adjacent a flat roof.

It would therefore be desirable to provide a temporary rooftop and stairway safety rail system that allows for rapid and easy deployment, installation, and removal, and is adapted for installation on either a wall or the spaced-apart parallel rafters of a pitched roof. In providing such a system, the present invention represents a substantial improvement over the foregoing and other prior art safety rail systems.

DISCLOSURE OF INVENTION

The temporary rooftop and stairway safety rail system of the present invention may be installed on a structure having a flat or a pitched roof, or on interior stairways or elevated floors. The system includes a plurality of safety rail support assemblies which attach to walls or roof rafters and which collectively support a system of horizontal barrier rails that prevent a worker from falling from a height.

In an embodiment adapted for attachment to a wall, the safety rail support assembly comprises a brace bracket and a wall mounting tube with a brace pivotally connected to each. The wall mounting tube includes a tube portion open at one end for insertion of an L-bar. The L-bar has a horizontal portion and a vertical portion. The horizontal portion of the L-bar may be adjustably positioned within the wall mounting tube.

Above the L-bar is a pitch adjustment bracket with a hollow neck and a bracket. The neck is fitted over the vertical portion of the L-bar. The bracket portion of the adjustment bracket includes an arcuate row of apertures adjacent its upper edge, and a vertical support member is adjustably positioned within the adjustment bracket and secured with a clevis pin. Thus, the vertical support member may be pivoted forward and rearward within the adjustment bracket portion and secured at a desired angle according to the conditions of the particular work site.

The vertical support member also includes a plurality of closed metal loop barrier rail retainers into which boards are end-lapped manner to create a continuous barrier rail between the support assemblies.

In an alternative preferred embodiment, the support assembly of the inventive safety rail system may be mounted on a plurality of roof rafters. In this embodiment, the safety rail support assembly includes a rafter mounting tube rather than a wall mounting tube; otherwise the components are substantially the same. The rafter mounting tube includes an integral lower bracket for pivotal connection to a brace, as in the first embodiment.

Accordingly, the entire safety rail support assembly is adapted for mounting on either a wall or a rafter, with only the need to swap the wall mounting tube for the rafter mounting tube. In this manner, the safety rail system can be quickly and easily moved from one work site to another, from a flat and level site to a steeply pitched work surface, and adjusted to fit the particular characteristics of the site. In the event that barrier rails are required along a stairway or elevated floor, the system can be mounted on an adjacent wall, stairway stringer, or other suitable structure. The system is designed for rapid deployment, installation, and removal, and these features are served by the pin-and-hole connection system employed throughout.

BEST MODE FOR CARRYING OUT THE INVENTION

Figure 1:
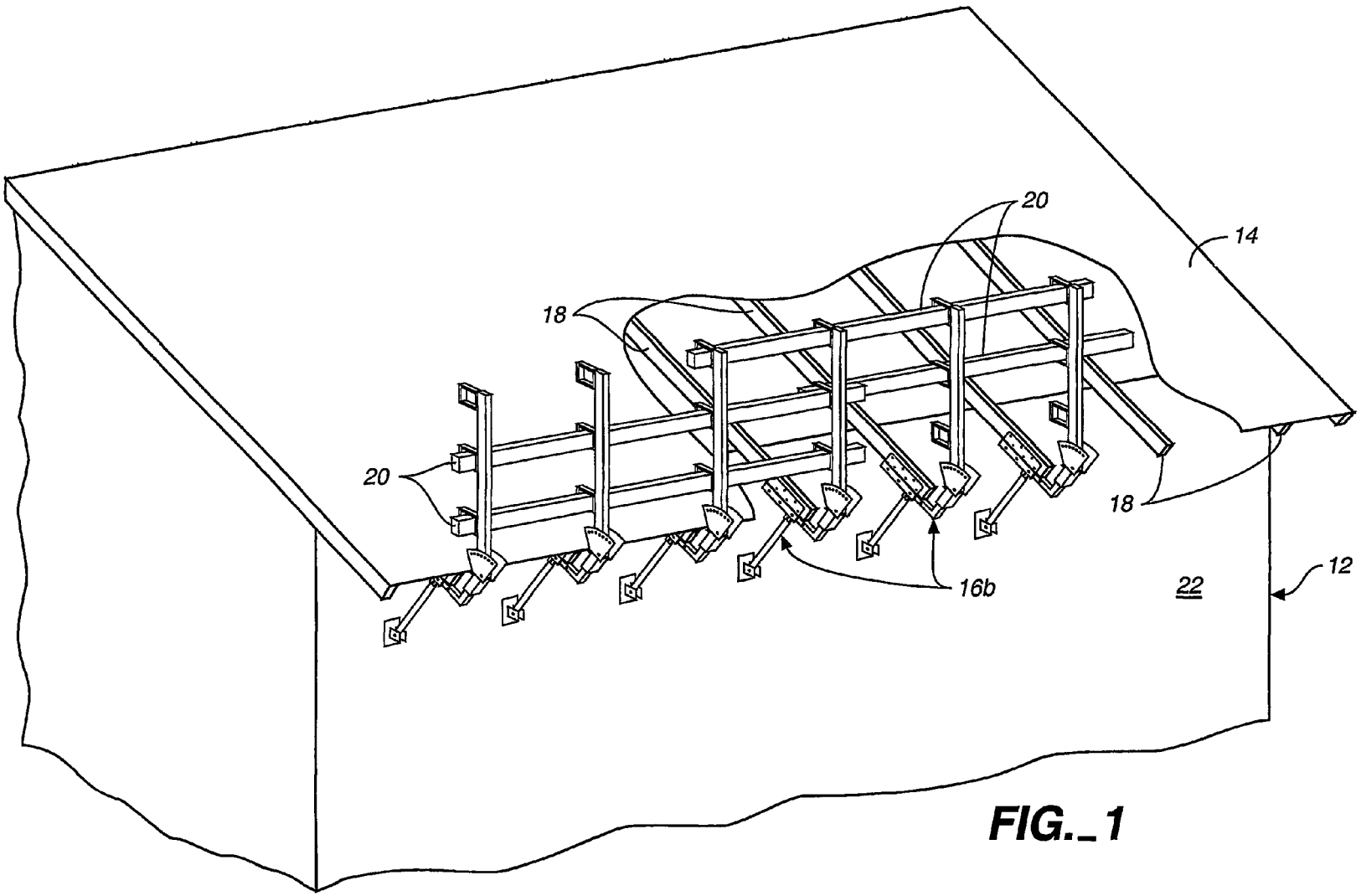
FIG. 1 is a perspective view showing the temporary rooftop and stairway safety rail system of the present invention installed on a structure having a pitched roof.

Referring to FIGS. 1 through 5, wherein like reference numerals refer to like components in the various views, FIG. 1 is a perspective view showing the temporary rooftop and stairway safety rail system of the present invention 10 installed on a structure 12 having a pitched roof 14. In this view the system is shown with four safety rail support assemblies 16*b*, each one attached to a roof rafter 18, and which collectively support a system of horizontal barrier rails 20 that prevent a worker from falling from the rooftop.

Figure 2B:
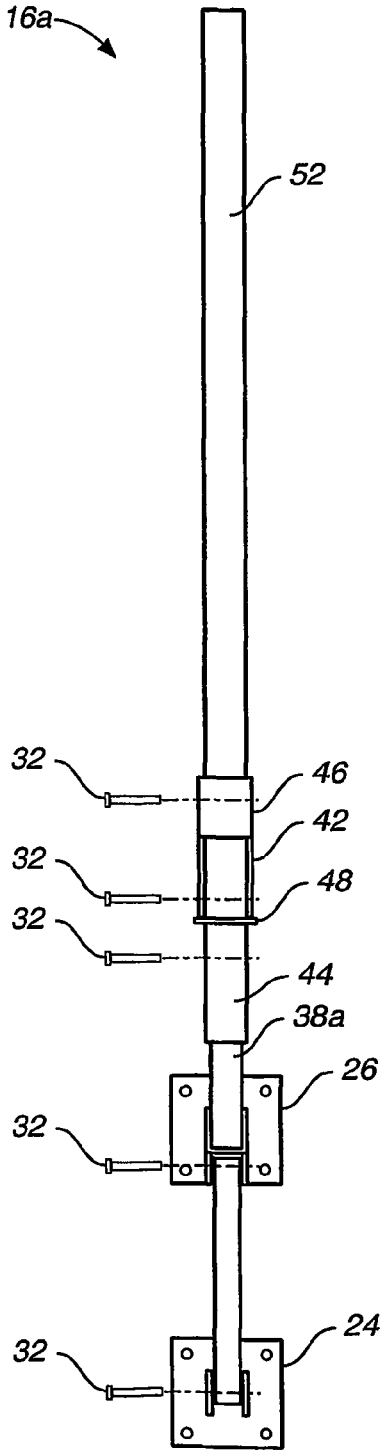
FIG. 2B is an end view in elevation of the safety rail support assembly of FIG. 2A.
Figure 2A:
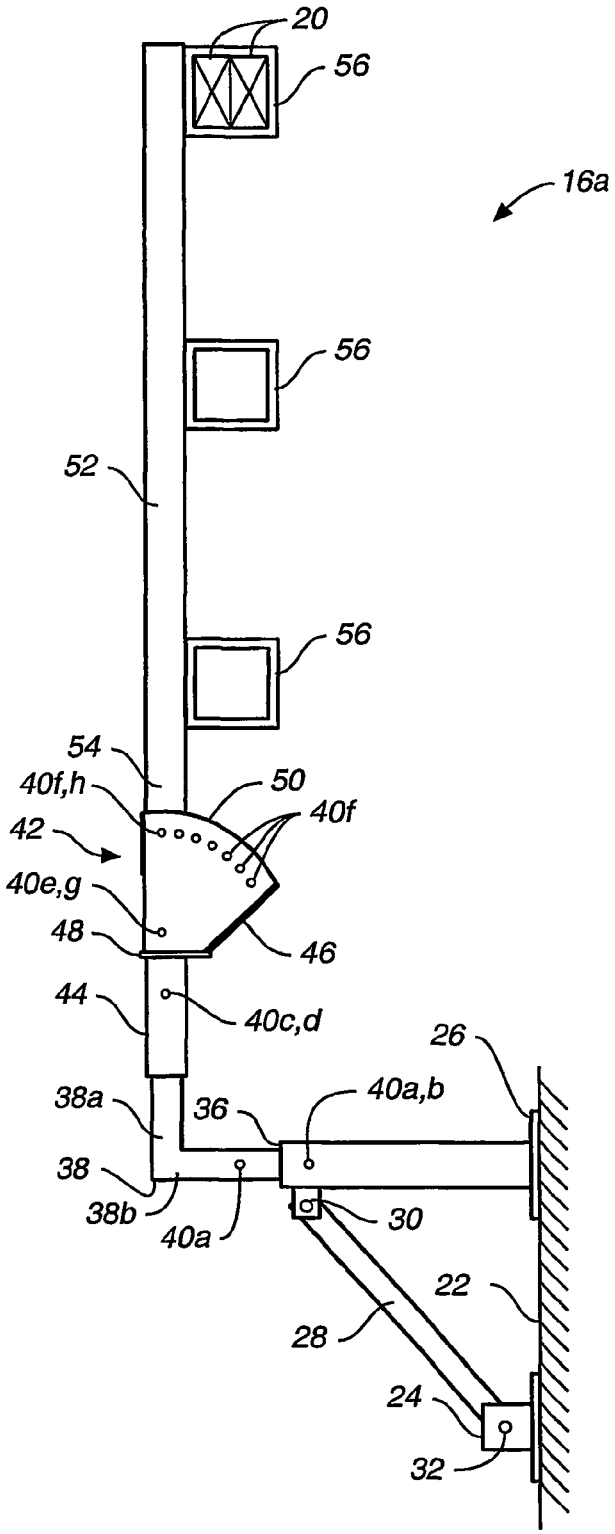
FIG. 2A is a side view in elevation of a single safety rail support assembly of the present invention shown installed on a wall.
Figure 2C:
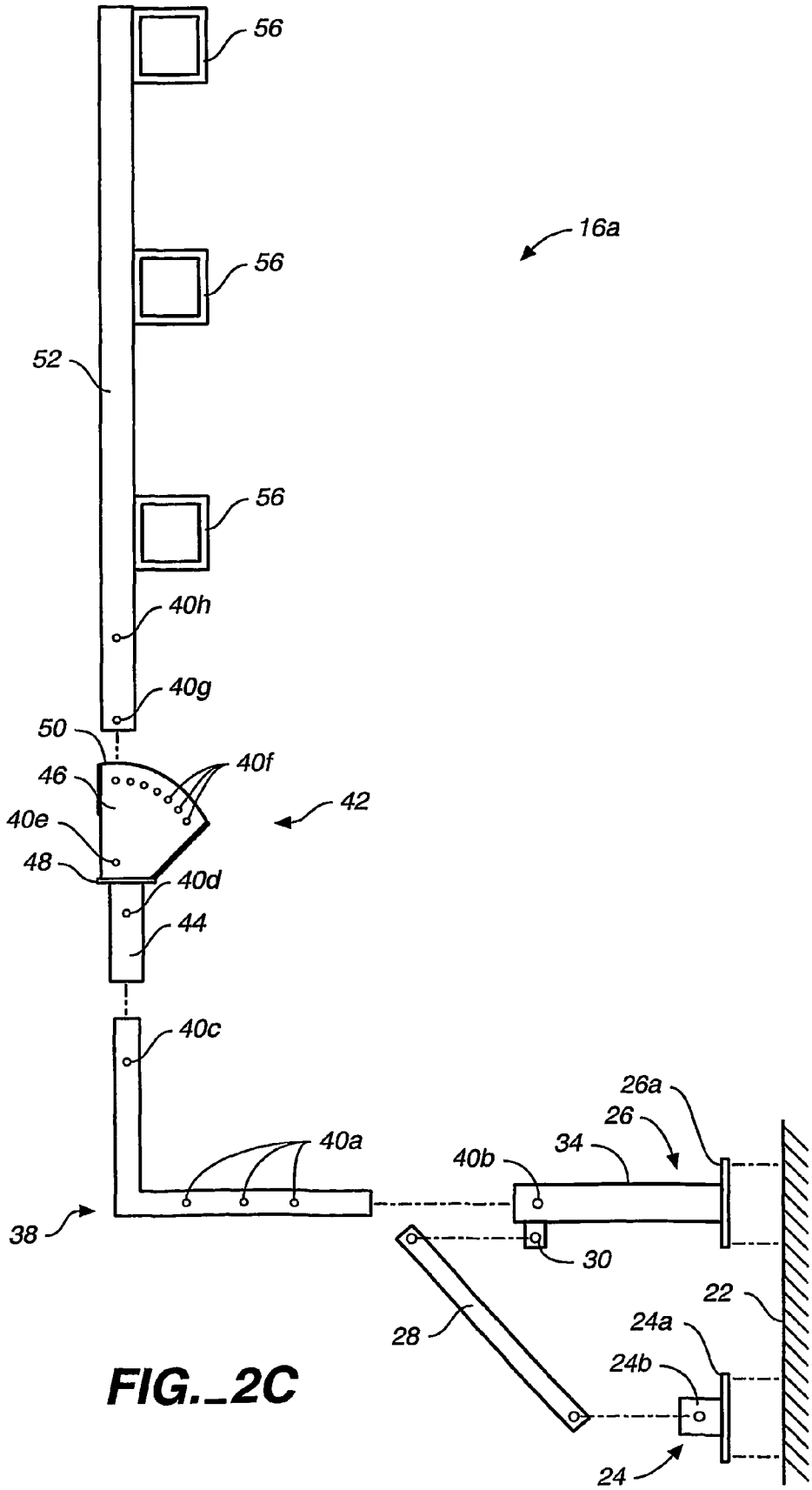
FIG. 2C is a exploded side view in elevation of the safety rail support assembly of FIGS. 2A and 2B.
Figure 3B:
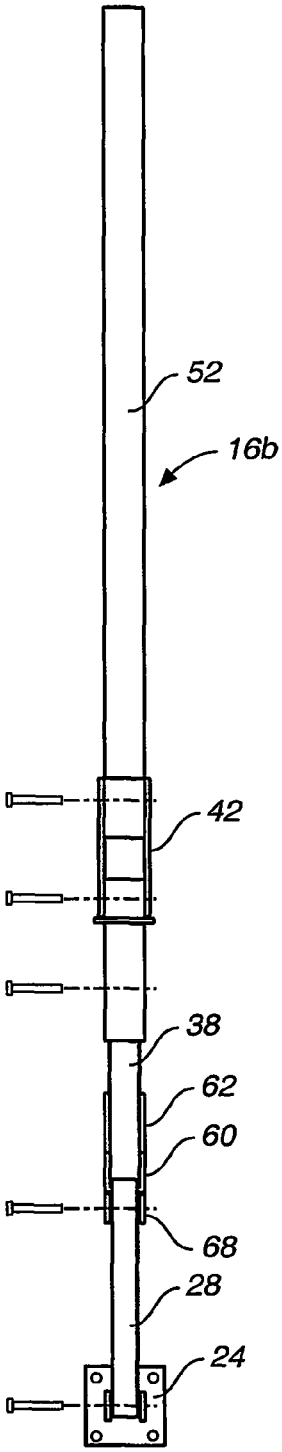
FIG. 3B is an end view in elevation of the safety rail support assembly of FIG. 3A.
Figure 3A:
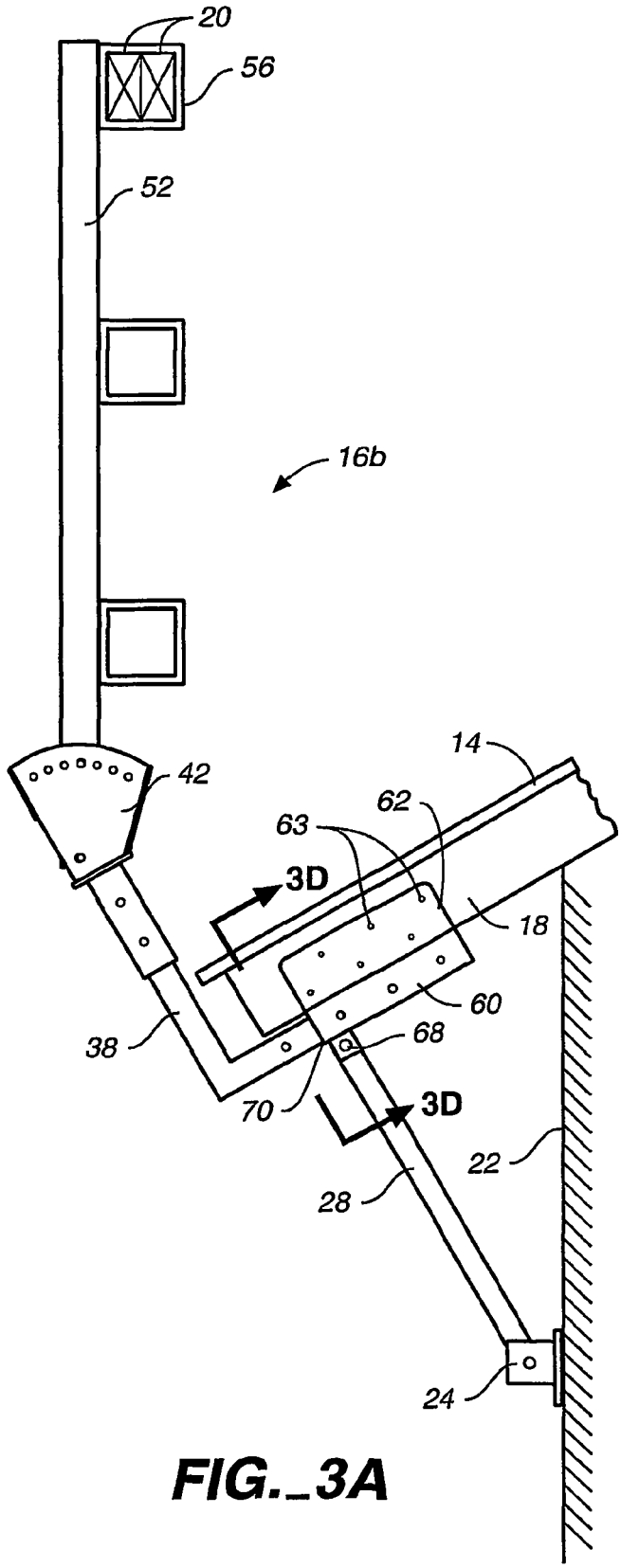
FIG. 3A is a side view in elevation of the safety rails support assembly as shown installed on a roof rafter.
Figures 3C, 3D:
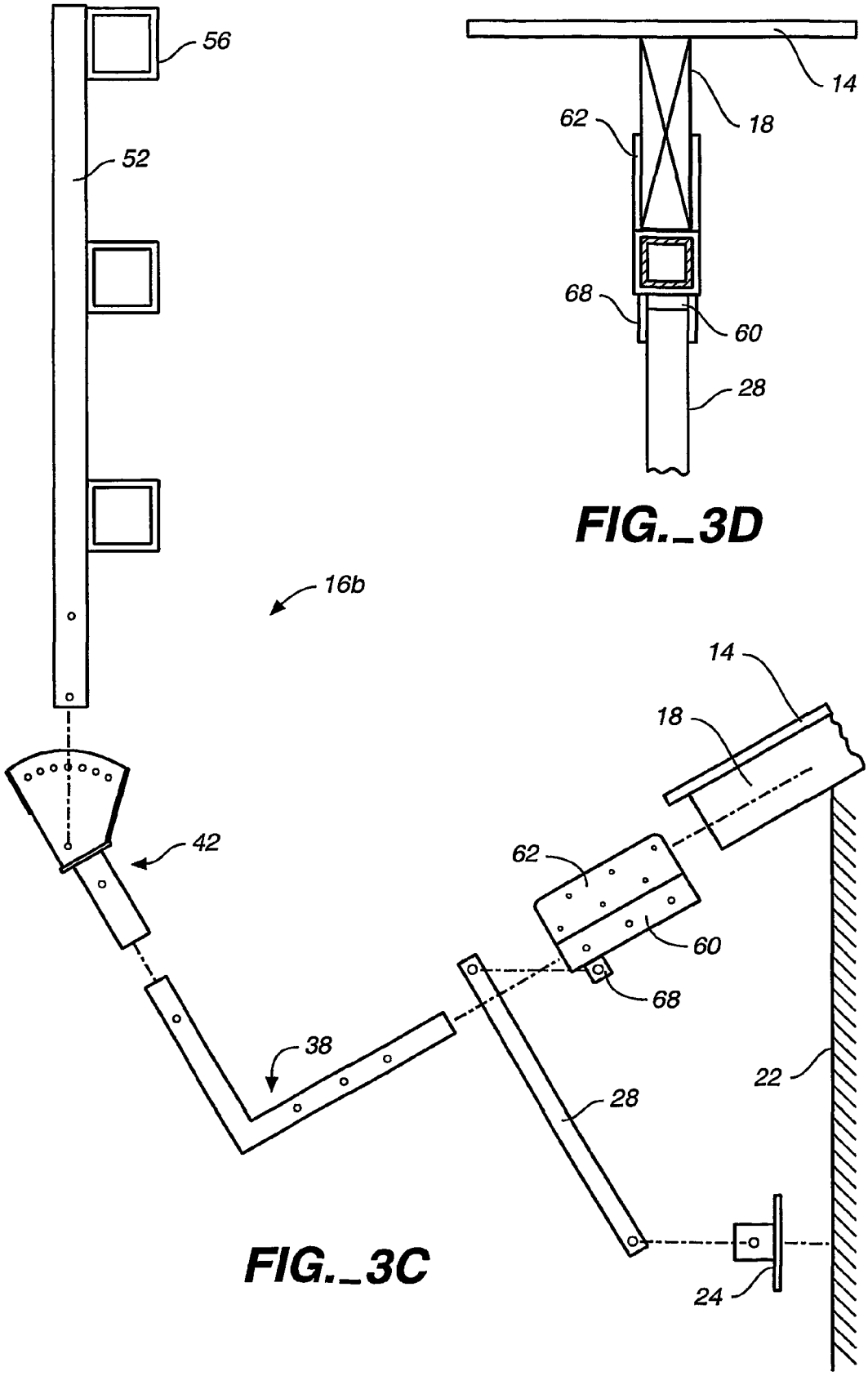
FIG. 3C is an exploded assembly view of the safety rail support assembly of FIGS. 3A and 3B.
FIG. 3D is a detailed end view showing the rafter mounting bracket of the support assembly of FIGS. 3A through 3C.

FIG. 2A is a cross sectional side view in elevation of a single safety rail support assembly of the present invention shown installed on a wall, FIG. 2B is an end view thereof, and FIG. 2C is a exploded side view in elevation of the safety rail support assembly 16*a* of FIGS. 2A and 2B. These views show that the safety rail support assembly of the inventive system is adapted for attachment to a wall 22, or to the parallel rafter frames of a pitched roof, as is shown in FIGS. 3A through 3C, and as more filly set forth below. When adapted for attachment to a wall, the support assembly comprises a brace bracket 24 and a wall mounting tube 26, between which is interposed a brace 28. The wall mounting tube includes an integral lower bracket 30. At its upper end the brace is pivotally connected with pins 32 to integral lower bracket 30 and at its lower end to brace bracket 24.

Wall mounting tube 26 includes a substantially square tube portion 34 which is open at its distal end 36 for insertion of an L-bar 38. The L-bar includes a generally horizontal portion 38*a* and a generally vertical portion 38*b*. The tube portion 34 of wall mounting tube 26 includes a plurality of apertures 40*a* which may be selectively aligned with apertures 40*b* in the horizontal portion 38*a* of L-bar 38, so that the L-bar may be adjustably positioned and fixed within the wall mounting tube. The vertical portion 38*b* also includes an aperture 40*c*.

Positioned above L-bar 38 is a pitch adjustment bracket 42, which includes a hollow neck portion 44 and a bracket portion 46. Vertical portion 38*b* of L-bar 38 is inserted into the hollow neck portion 44 of pitch adjustment bracket 42 where aperture 40*c* is aligned with an aperture 40*d* in the neck portion 44 for fixing with a pin. The bracket portion 46 includes a single aperture 40*e* near its base 48 and an arcuate row of apertures 40*f* adjacent its upper edge 50.

A vertical support member 52 is adjustably positioned within the bracket portion 46 of pitch adjustment bracket 42. The vertical support member 52 has an aperture 40*g* at its lower end 54 which is aligned with aperture 40e and secured by a pin 32. Vertical support member 52 may be pivoted forward and rearward within bracket portion 46 and secured at a desired angle by aligning an aperture 40h with one of the arcuate apertures 40f in the bracket and securing it with a pin 32.

Vertical support member further includes a plurality of barrier rail retainers 56, which comprise closed metal loops, adapted for insertion of boards 20 in an end-lapped manner so as to function as a continuous barrier rail within the region of the installed support assemblies (also see reference number 20 in FIG. 1).

FIG. 3A is a side view in elevation of the safety rails support assembly as shown installed on a roof rafter, and FIG. 3B is an end view thereof. FIG. 3C is an exploded assembly view of the safety rail support assembly of FIGS. 3A and 3B. FIG. 3D is a detailed end view showing the rafter mounting bracket of the support assembly of FIGS. 3A through 3C. Collectively, these views show that an alternative embodiment of the support assembly 16*b* of the inventive safety rail system may be mounted on a plurality of roof rafters as well as on a wall. In this instance the safety rail support assembly 16*b* comprises components identical or substantially identical to those of the wall mounted assembly 16*a*, but the wall mounting tube is replaced by a rafter mounting tube 60 having a longitudinal bracket 62 including a plurality of apertures 63 for the insertion of fasteners (preferably wood screws) to affix the rafter mounting tube to a roof rafter or rafter tail 18. When mounted on the rafters supporting a pitched roof 14, the vertical support member 52 may be pitched forward toward the roof within the pitch adjustment bracket 42 so that it is disposed substantially vertically relative to ground. It will be readily apparent that the vertical support member may be adjusted to any of a number of suitable angles according to the pitch of the work surface. As with the wall mounting tube, the rafter mounting tube has an opening at its distal end 70 and further includes an integral lower bracket 68 for pivotal connection to brace 28, which is adaptable for use in either a rafter mounted installation or a wall mounted installation.

The present invention is not limited in any manner by particular materials or dimensions. Nonetheless, in a particular preferred embodiment directed for use on a typical roof having 2.times.6 roof rafters and a ⅝ inch plywood overlay, the preferred material is aluminum and the preferred dimensions are as follows:

(a) brace bracket 24 has a 10.160 cm square base 24*a,* and a 3.81 square bracket portion 24*b;*

(b) wall mounting tube 26 has a square base 26*a* measuring 10.160 cm on each side, and a 30.48 cm hollow tube portion 34;

(c) brace 28 is hollow square tubing 127.00 cm in length and 3.175 cm on each of its sides (lengthened to 40.64 cm in the wall mounting version, or simply extended appropriately if brace 28 is adjustable in length);

(d) integral lower bracket 30 is 3.81 cm square on each of its sides;

(e) L-bar 38 is hollow square tubing 30.480 cm along its generally vertical arm 38*a,* 38.100 cm along its generally horizontal arm 38*b,* and 3.81 cm on each of its sides;

(f) pitch adjustment bracket 42 has a square hollow tube neck portion 44 that is 15.240 cm in length and 5.08 cm on each of its sides, and a bracket portion 46 that is 17.780 cm deep;

(g) vertical support member 52 is square hollow tubing 111.760 cm in length and 5.40 cm on each of its sides;

(h) barrier rail retainers 56 are closed metal loops 10.160 cm on each side; and (i) rafter mounting tube 60 is square hollow aluminum tubing 3.962 cm on each side and 22.860 cm in length; upper bracket 62 is also 22.860 cm in length and 7.620 cm in height.

The pins may comprise any of a number of suitable fastening means, though the preferable tackle is a pin-and-clevis combination.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A temporary rooftop and stairway safety rail system adapted to prevent workers from falling from a work surface at a height comprising:

a plurality of safety rail support assemblies (16), said support assemblies having a vertical support member (52) with board retention means (56) for holding end-lapped horizontal boards (20) to create a horizontal barrier;

mounting means for mounting said safety rail support assemblies on walls and roof rafters; and pitch adjustment means for adjusting the pitch of said vertical support member relative to the slope of the work surface;

wherein said mounting means comprises a brace bracket (24); a wall mounting tube (26) having an integral lower bracket (30), said wall mounting tube having a tube portion open at its distal end (36); a brace (28) pivotally connected with pins (32) to said brace bracket and said integral lower bracket and interposed therebetween, an L-bar (38) having a horizontal portion (38*a*) and a vertical portion (38*b*), said L-bar sized to fit within said opening at said distal end of said tube portion of said wall mounting tube; and connection means for connecting said wall mounting tube and said L-bar.

2. The safety rail system of claim 1, wherein said connection means comprises:

at least one pin adapted for removable insertion into aligned apertures in said tube portion of said wall mounting tube and said horizontal portion of said L-bar.

3. The safety rail system of claim 2, wherein said horizontal portion of said L-bar and said tube portion of said wall mounting tube each have a plurality of apertures such that the apertures in said L-bar may be selectively and adjustably aligned with the apertures in said wall mounting tube.

4. The safety rail system of claim 1, wherein said pitch adjustment means comprises:

a pitch adjustment bracket (42) having a hollow neck portion (44) and a bracket portion (46), said neck portion connected to said vertical portion of said L-bar, said bracket portion (46) having an aperture (40*e*) proximate its base (48) and an arcuate row of apertures (40*f*) adjacent its upper edge (50); and a vertical support member (52) adjustably positioned within said bracket portion (46) of said pitch adjustment bracket (42), said vertical support member (52) having an intermediate aperture (40*h*) and a lower aperture (40*g*) at its lower end (54) which is aligned with aperture (40*e*) of said bracket portion of said pitch adjustment bracket and pivotally connected therein by a pin (32), wherein said vertical support member may be pivoted forward and rearward within said bracket portion and secured at a desired angle by aligning aperture (40*h*) with one of the arcuate apertures (40*f*) in the bracket and securing it with a pin, said vertical support member further including a plurality of barrier rail retainers (56) adapted for insertion of horizontal boards (20) in an end-lapped manner so as to function as a continuous barrier rail between support assemblies when installed.

5. A temporary rooftop and stairway safety rail system adapted to prevent workers from falling from a work surface at a height, comprising:

a plurality of safety rail support assemblies (16), said support assemblies having a vertical support member (52) with board retention means (56) for holding end-lapped horizontal boards (20) to create a horizontal barrier;

mounting means for mounting said safety rail support assemblies on walls and roof rafters; and pitch adjustment means for adjusting the pitch of said vertical support member relative to the slope of the work surface;

wherein said mounting means comprises:

a brace bracket (24);

a rafter mounting tube (60) having a longitudinal bracket (62) including a plurality of apertures for the insertion of fasteners to affix the rafter mounting tube to a roof rafter, said rafter mounting tube having an opening at its distal end (70) and an integral lower bracket (68);

a brace (28) pivotally connected with pins (32) to said brace bracket and said integral lower bracket (68) and interposed therebetween;

an L-bar (38) having a horizontal portion (38*a*) and a vertical portion (38*b*), said L-bar sized to fit within said opening at said distal end of said rafter mounting tube; and connection means for connecting said rafter mounting tube and said L-bar.

6. The safety rail system of claim 5, wherein said connection means comprises:

at least one pin adapted for removable insertion into aligned apertures in said rafter mounting tube and said horizontal portion of said L-bar.

7. The safety rail system of claim 6, wherein said horizontal portion of said L-bar and said rafter mounting tube each have a plurality of apertures such that the apertures in said L-bar may be selectively and adjustably aligned with the apertures in said rafter mounting tube.

8. The safety rail system of claim 5, wherein said pitch adjustment means comprises:

a pitch adjustment bracket (42) having a hollow neck portion (44) and a bracket portion (46), said neck portion connected to said vertical portion of said L-bar, said bracket portion (46) having an aperture (40*e*) proximate its base (48) and an arcuate row of apertures (40*f*) adjacent its upper edge (50); and a vertical support member (52) adjustably positioned within said bracket portion (46) of said pitch adjustment bracket (42), said vertical support member (52) having an intermediate aperture (40*h*) and a lower aperture (40*g*) at its lower end (54) which is aligned with aperture (40*e*) of said bracket portion of said pitch adjustment bracket and pivotally connected therein by a pin (32), wherein said vertical support member may be pivoted forward and rearward within said bracket portion and secured at a desired angle by aligning aperture (40*h*) with one of the arcuate apertures (40*f*) in the bracket and securing it with a pin, said vertical support member further including a plurality of barrier rail retainers (56) adapted for insertion of horizontal boards (20) in an end-lapped manner so as to function as a continuous barrier rail between support assemblies when installed.

9. A safety rail support assembly (16) adapted for use in a rooftop and stairway safety rail system, comprising:

a brace bracket (24), a wall mounting tube (26) having an integral lower bracket (30), and a brace (28) pivotally connected with pins (32) to said brace bracket and said integral lower bracket and interposed therebetween, said wall mounting tube having a tube portion open at its distal end (36), said tube portion having a plurality of apertures (40*a*);

an L-bar (38) having a generally horizontal portion (38*a*) and a generally vertical portion (38*b*) having at least one aperture (40*c*), said horizontal portion having a plurality of apertures and adjustably inserted into said opening at said distal end of said tube portion of said wall mounting tube, aligned with at least one of the plurality of apertures in said tube portion of said wall mounting tube, and secured with at least one pin;

a pitch adjustment bracket (42) having a hollow neck portion (44) including an aperture (40*d*), and a bracket portion (46), said neck portion fitting over said vertical portion of said L-bar so that the apertures in said neck portion and said vertical portion of said L-bar align for insertion of a pin, said bracket portion (46) having an aperture (40*e*) proximate its base (48) and an arcuate row of apertures (40*f*) adjacent its upper edge (50); and a vertical support member (52) adjustably positioned within said bracket portion (46) of said pitch adjustment bracket (42), said vertical support member (52) having an intermediate aperture (40*h*) and a lower aperture (40*g*) at its lower end (54) which is aligned with aperture (40*e*) of said bracket portion of said pitch adjustment bracket and pivotally connected therein by a pin (32), wherein said vertical support member may be pivoted forward and rearward within said bracket portion and secured at a desired angle by aligning aperture (40*h*) with one of the arcuate apertures (40*f*) in the bracket and securing it with a pin, said vertical support member further including a plurality of barrier rail retainers (56) adapted for insertion of horizontal boards (20) in an end-lapped manner so as to function as a continuous barrier rail between support assemblies when installed.

* * * * *